US005699991A

United States Patent [19]

Melinyshyn

[11] Patent Number: 5,699,991

[45] Date of Patent: Dec. 23, 1997

[54] PORTABLE CAMPING EQUIPMENT HANGER

[76] Inventor: Matthew John Melinyshyn, 3892 Brewer's Mills Rd., R.R. #1, Seeley's Bay, Ontario, Canada, K0H 2N0

[21] Appl. No.: 824,214

[22] Filed: Mar. 25, 1997

Related U.S. Application Data

[63] Continuation of Ser. No. 440,959, May 15, 1995.

[30] Foreign Application Priority Data

May 30, 1994 [CA] Canada ..... 2124632

[51] Int. Cl.[6] ..... A47H 1/10

[52] U.S. Cl. ..... 248/332; 248/332.1

[58] Field of Search ..... 248/332, 332.1; 254/389–391, 380, 401, 409, 410, 415; 294/19.1, 1.1, 74

[56] References Cited

U.S. PATENT DOCUMENTS

| | | |
|---|---|---|
| 1,381,410 | 6/1921 | Frink . |
| 1,782,348 | 11/1930 | Hillier . |
| 2,931,629 | 4/1960 | Keller . |
| 3,705,708 | 12/1972 | Cunningham . |
| 3,854,168 | 12/1974 | Bradley . |
| 3,894,313 | 7/1975 | Miller . |
| 3,944,186 | 3/1976 | Einhorn et al. . |
| 4,079,916 | 3/1978 | Einhorn et al. . |
| 5,049,110 | 9/1991 | Owens . |

*Primary Examiner*—Carl D. Friedman
*Assistant Examiner*—Beth Aubrey
*Attorney, Agent, or Firm*—Bereskin & Parr; Philip Mendes da Costa

[57] ABSTRACT

A method to enable a single individual to raise a payload and store the payload at an elevated height above the ground comprises providing first and second flexible elongate line members, each of the line members having a first and, a second end and an intermediate portion and the first flexible line member having a pulley secured to the first end thereof. A support member at an elevated height is located. The first line member is passed over the support member so that the intermediate portion of the first line member passes over the support member and the pulley and the second end of the first line member are each positioned adjacent the ground. The second flexible elongate line member is passed through the pulley. The pulley is raised to an elevated position and secured in that position. A payload is secured to the first end of the second flexible member. The payload is raised to an elevated position and secured in that position. The invention also comprises a kit for performing this method.

8 Claims, 2 Drawing Sheets

PORTABLE CAMPING EQUIPMENT HANGER

This application is a continuation of U.S. application Ser. No. 08/440,959 filed May 15, 1995.

FIELD OF THE INVENTION

This invention generally relates to camping equipment. In particular, the invention relates to a portable apparatus which may be used to suspend camping equipment and provisions, including food, so that wild animals do not have access thereto.

BACKGROUND OF THE INVENTION

During camping expeditions, it is necessary to store provisions and equipment out of the reach of wild animals. This is particularly the case at night where it is necessary to maintain food provisions in a safe environment. One method which has been used in the past by campers is to store the provisions suspended from a tree branch. In order to achieve this result, the camper may climb a tree and drape a rope over a suitable limb. One problem with this method is that there may not be a tree which is suitable for climbing. In addition, campers may injure themselves if they fall from the tree during the placement of the rope. Further, a camper's fear of heights or lack of skill in climbing a tree may preclude the use of this method.

A second method which has been used by campers is to tie a rock to the end of a rope and to throw the rock, when secured to the rope, over a branch. One problem with this approach is finding a suitable rock and, in addition, securing the rock to the rope. Frequently, the rock may become disengaged from the rope during the throwing operation with the potential of causing injury to the thrower or bystanders.

Once the rope has been passed over the branch, the provisions are secured to one end of the rope and the provisions are hoisted to an elevated position. This portion of the operation also has several disadvantages. First, the passage of the rope over the branch causes substantial friction. This can cause damage to the rope which will eventually require its replacement. Further, this friction may cause the rope to bind to the branch over which it traverses. In addition, this friction reduces the maximum weight of provisions and equipment which may be lifted to a secured storage position. The friction of the rope passing over the branch increases the force which is exerted on the branch thus increasing the risk that the branch may in fact break as the provisions and equipment are raised to an elevated position.

Various devices have been developed for use by hunters to temporarily support game. U.S. Pat. No. 2,931,629 discloses a Deer Pull and Pulley. According to this device, two loops of rope are attached to a sleeve. One of the loops of rope has a longitudinally extending bar attached thereto. By passing one loop of rope through and around the bar, the two loops may be secured together to form a continuous loop commencing at and extending to the sleeve. A pulley is affixed to the sleeve. The two loops may be used to provide a means to support the pulley in an elevated position such as by tying the loops over a branch. By passing a rope through the pulley, the game may also be held at an elevated position. Alternately, the two loops may be rearranged and form a backpack harness.

U.S. Pat. No. 3,894,313 discloses a Game Hanger which comprises a collapsible frame which is generally of an inverted U shape configuration. A block and tackle supports a hanger which is affixed to the central portion of the frame. The entire frame is supported at an acute angle to the ground by a nylon rope which is tied at one end to a stake inserted into the ground and at the other to the central portion of the frame.

Other portable devices for supporting game at an elevated position include U.S. Pat. Nos. 3,854,168 for a Skinning Tree and 5,049,110 for a Portable Game Support.

Each of these devices is specifically designed to support game. Further, each of the devices has various disadvantages. Some of these devices involve complicated constructions which decrease the utility of the devices. In particular, some of the devices use frame members for supporting game at an elevated height.

SUMMARY OF THE INVENTION

The present invention provides a method to enable a single individual to raise a payload and store the payload at an elevated height above the ground comprising the steps of:

(a) providing first and second flexible elongate line members, each of said line members having a first end, a second end and an intermediate portion, said first flexible line member having pulley means secured at said first end;

(b) locating a support member at an elevated height;

(c) passing said first line member over said support member so that said intermediate portion of said first line member passes over said support member and said pulley means and said second end are each positioned adjacent the ground;

(d) passing said second flexible elongate line member through said pulley means such that said intermediate portion of said second flexible elongate line member is positioned within said pulley means;

(e) raising said pulley means to an elevated position above the ground and securing said pulley means at said elevated position thereby raising said intermediate portion of said second flexible elongate line member to said elevated position;

(f) securing a payload to said first end of said second elongate flexible line member; and, (g) using said second end of said elongate flexible member to raise the payload to said elevated position and securing the payload at said elevated position.

Preferably, the support member which is utilized to support the payload at the elevated position is the branch of a tree. However, a camper may utilize any elevated member which is capable of supporting a load and is at a suitable height for passing the first flexible elongate line member thereover. The first line member may be secured in the elevated position by tying the second end of said line member around the trunk of the selected tree. Similarly, the payload may be secured at the elevated position by tying the second end of said second elongate flexible line member to the trunk of the tree. However, the second ends of the line members may be tied to a root which protrudes from the ground, a rock or they may even be staked to the ground.

In accordance with this invention, a kit for performing this method is also provided. The kit comprises first and second elongate line members, each of the line members having a first end, a second end and an intermediate portion, the first flexible line member has pulley means secured at the first end and the line members are dimensioned to extend from the ground to an elevated support member and back to the ground.

One advantage of the use of the instant invention is that a camper does not have to select a camping site near a tree which the camper can climb. In addition, all set up can be performed from the ground and there is no tree climbing required to set up or take down the cached equipment using the method of the instant invention. By using the kit of the instant invention, a camper need only locate a tree branch or other raised platform which is within the camper's throwing reach. By throwing the pulley means over the branch, the camper may easily and quickly support the camping equipment at an elevated height without any need to leave the ground.

A further advantage is that the camper does not have to locate a suitable rock for affixing to a rope so that it will remain affixed to the rope as the rope is thrown over a branch. As the rope is easily and firmly secured to the pulley, there is no danger that the pulley will come loose from the rope at any time. In addition, the pulley may be designed as an appropriately weighted item to allow for easy and targeted throwing over the selected branch or platform.

The presence of a pulley mechanism provides easier lifting capabilities as compared to resistance which is encountered when simply trying to hoist a load with a rope dragged over a limb. The pulley mechanism allows for a larger weight of goods to be secured at an elevated position than the use of a rope dragged over a limb. Further, the use of the method of this instant invention provides peace of mind that equipment and food is securely cached and easily accessible.

DESCRIPTION OF THE DRAWINGS

The substance and advantages of the invention may be more completely and fully understood by means of the following description of the accompanying drawings of a preferred embodiment of the kit and method which are the subject of this invention in which.

DESCRIPTION OF THE PREFERRED EMBODIMENT

Figure 1:
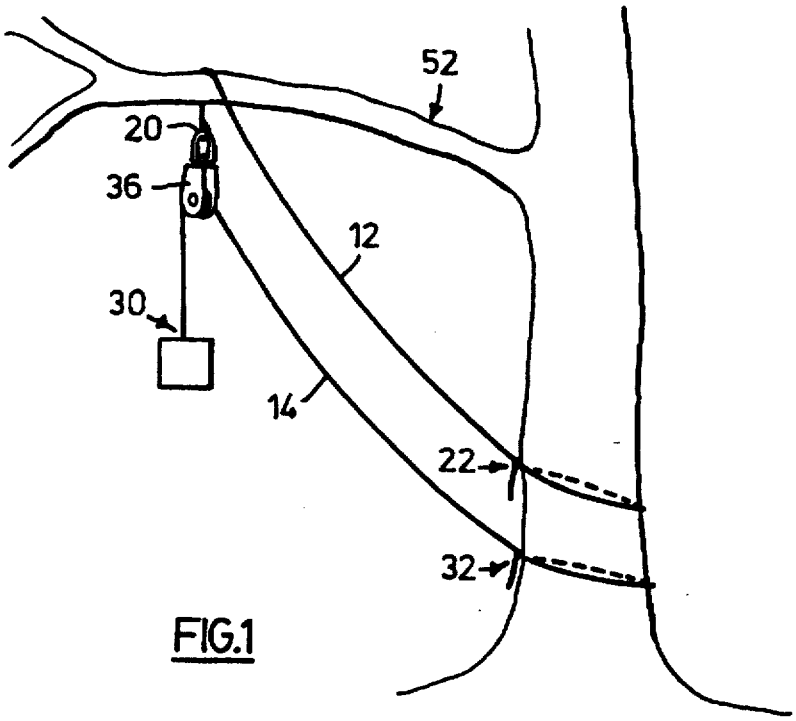
FIG. 1 is a perspective view of the kit of the instant invention securing payload at an elevated position.
Figure 2:
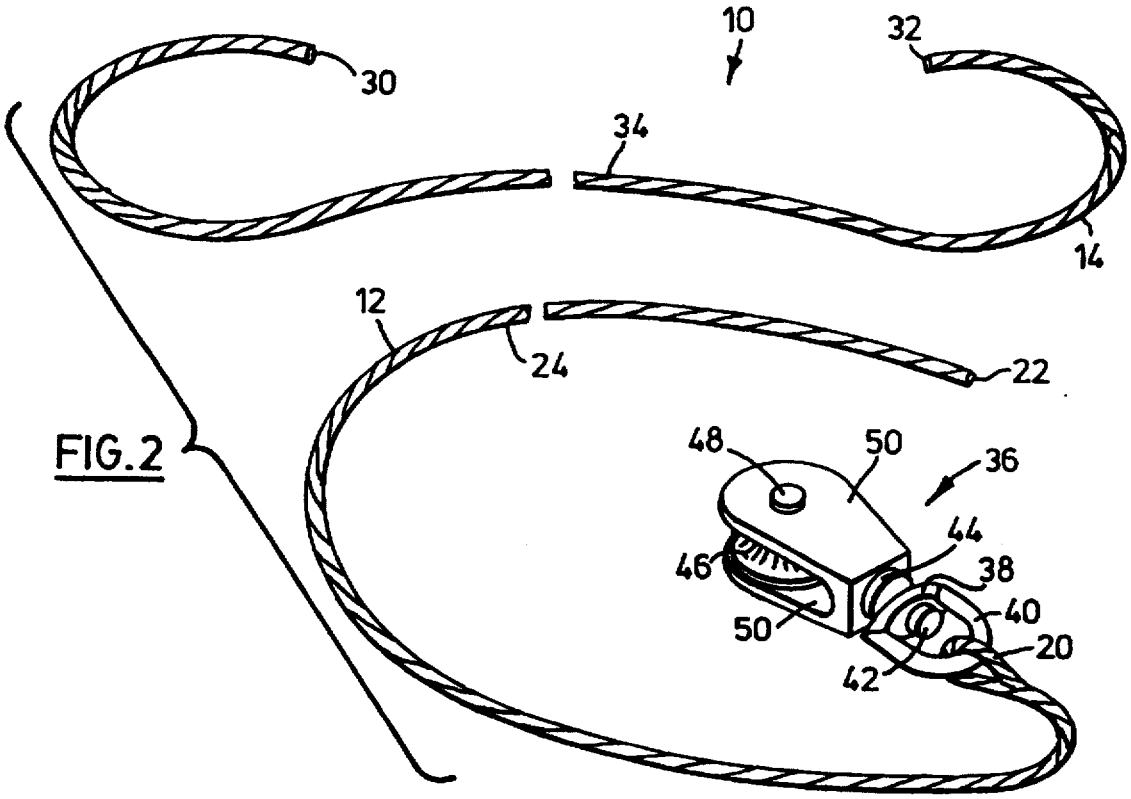
FIG. 2 is an enlarged view of the apparatus of FIG. 1.

The kit of the instant invention, generally designated by reference numeral 10 in FIG. 2, comprises a first elongate line member 12 and a second elongate line member 14. First elongate line member 12 has first end 20, second end 22 and intermediate portion 24. Second elongate line member 14 has first end 30, second end 32 and intermediate portion 34.

The flexible elongate line members may be made of any suitable material used in camping. Preferably, the flexible elongate line members are made of rope, such as nylon or polypropylene cord. The rope has a dimension sufficient to support the weight of the payload to be hoisted. The rope is of a suitable length to extend upwards to a support member and back down to the ground therefrom. Typically, the length of each line member will be from about 10 to about 50 feet and, preferably, from about 20 to about 40 feet.

First flexible elongate line member 12 has pulley means, generally designated by reference numeral 36, secured to first end 20. Pulley means 36 has clevis 40. First end 20 may be secured through clevis 40 by any manner known in the art. Most simply, first end 20 may be passed through clevis 40 and then tied around elongate member 12. Preferably, pulley means 36 has a universal joint to allow the pulley to swivel around the longitudinal axes defined by elongate member 12. Accordingly, pulley 36 may have a swivel 42 which is formed as part of head 44. Clevis 40 is secured to annular base 38. Annular base 38 is affixed to clevis 40 by any means known in the art or it may be formed integrally therewith. Swivel 42 is dimensional to have a neck (not shown) which passes through the central opening in annular base 38 and which permits annular base 38 to rotate therearound. Grooved wheel 46 is rotationally mounted on axle 48. Axle 48 is mounted on side panels 50 which are affixed to head 44. Grooved wheel 46 is dimensioned so as to receive second line member 14.

As discussed herein below, kit 10 may be employed by the method of the instant invention to simplify the raising of a payload to an elevated position. Referring to FIGS. 3*a*–3*f* inclusive, a suitable support member 52 is located. Generally, the most convenient support member available during camping expeditions is a branch which is located from about 10 to about 25 feet above the ground. Once the support member has been located, first elongate line member 12 is passed over the support member so that the intermediate portion of the first line member passes over the support member and the pulley means and the second end are each positioned adjacent the ground (see FIG. 3*b*). In order to perform this operation, the camper may take hold of pulley means 36 and use same to throw first elongate line member 12 over support member 52. The pulley means has a sufficient weight to enable the camper to usually throw first elongate line member 12 over support member 52. As pulley means 36 passes over support member 52, a sufficient amount of line member 12 is played out to allow pulley means 36 to extend to the ground.

Subsequently, second flexible elongate line member 14 is passed through pulley means 36 such that intermediate portion 34 is positioned within pulley means 36. This results in the position shown in FIG. 3*c*. This operation is easily conducted since pulley means 36 is positioned adjacent the ground.

Figure 3A:
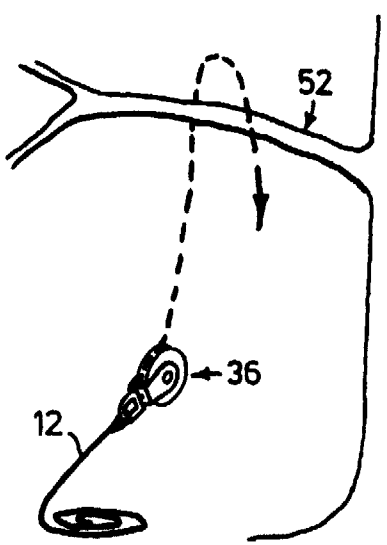
FIGS. 3*a*–3*f* inclusive demonstrate the method of securing a payload at an elevated position using the kit of FIG. 2.
Figure 3B:
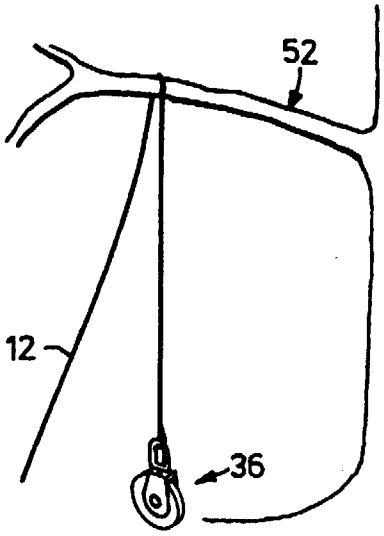
Figure 3C:
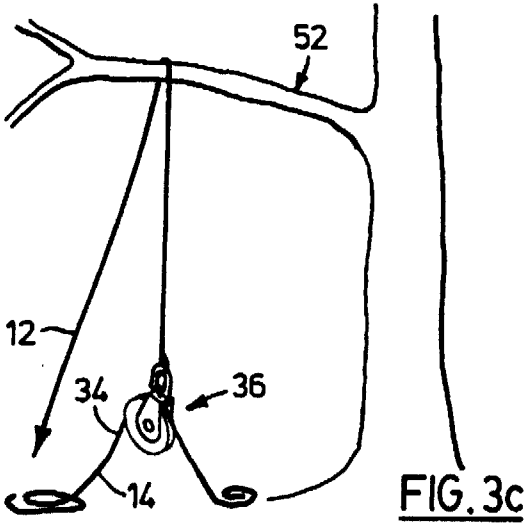
Figure 3D:
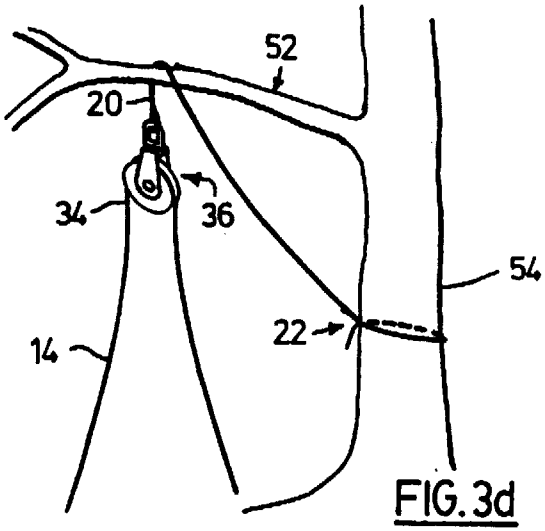
Figure 3E:
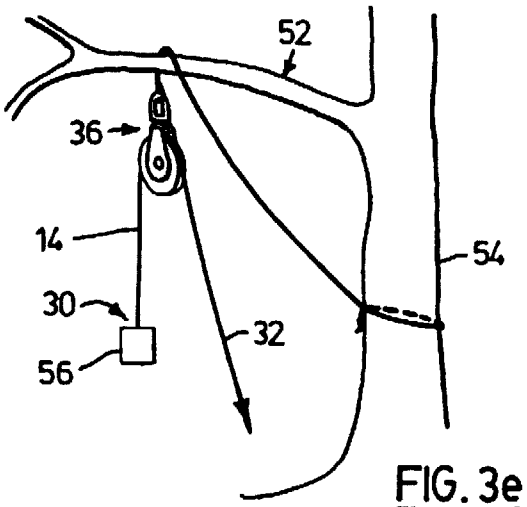

Pulley means 36 is then raised to an elevated position above the ground and secured at that elevated position (see FIG. 3*d*). By this operation, intermediate portion 34 of second flexible elongate member 14 is raised to an elevated position. Pulley means 36 may be raised to the elevated position by using second end 22 to hoist pulley means 36 to the elevated position. During this operation, pulley means 36 and second line member 14 comprise only a negligible weight which is attached to first end 20 of first flexible line member 12. This is a simpler operation than if a payload were directly attached to first end 20. If a payload were so attached, then much greater stress would be applied to support member 52 and, in some cases, support member 52 may break under the strain. Further, substantial effort would have to be exerted by the camper when pulling end 22 to raise first end 20 and the payload attached thereto.

Once pulley means 36 is in the elevated position, pulley means 36 may be secured in the raised position by affixing second end 22 to a member 54 which is secured to the ground. Member 54 may be the trunk of a tree, a root protruding from the ground, a rock of sufficient weight or even a spike which is inserted by the camper into the ground. As shown in FIG. 3*d*, second end 22 may be tied around a tree trunk to secure pulley means 36 at the elevated position.

Figure 3F:
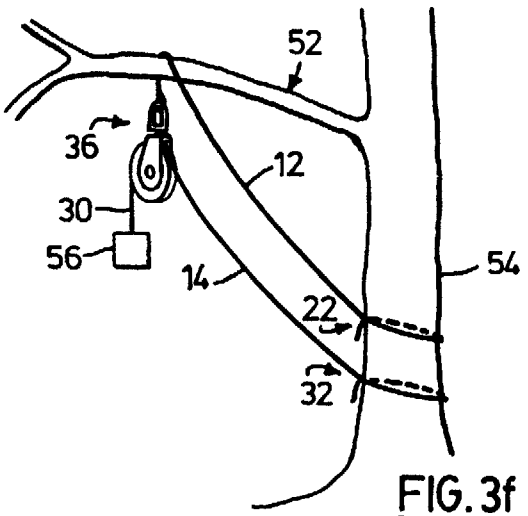

At this time, payload 56 may be secured to first end 30 of second line member 14. The payload may be secured by any means known in the art. The payload is now ready to be raised to the elevated storage position. To perform this operation, the camper may, by pulling along second end 32 of line member 14, hoist the payload to the elevated position shown in FIG. 3*f*. Once in that position, the payload is secured for storage. To achieve this result, the camper may secure second end 32 of line member 14 in the same manner as second end 22 of line member 12. As shown in FIG. 3*f*, second end 32 is tied around member 54.

Pulley means 36 provides a relatively frictionless means to raise payload 56 to the storage position. Line member 14 passes easily around grooved wheel 46. The forces exerted by payload 56 and the camper on second line 14 during the hoisting operation are transmitted in a controlled manner to support member 52 through line member 12. This reduces the dynamic loading of support member 52 as the payload is hoisted to the storage position. Accordingly, a greater load may be placed on a support member 52 by using this method and kit. In addition, much less effort is required by the camper to raise payload 56 to the elevated position by using this method and all this can be done without the camper having to leave the ground. Further, once the pulley means is in place, the payload may repeatedly be raised and lowered without performing the steps set out in FIGS. 3(*a*) to 3(*c*).

I claim:

1. In camping, a method to enable a single individual to raise a payload including camping equipment and/or provisions and store the payload at an elevated height above the ground comprising the steps of:

(a) providing first and second flexible elongate line members and a pulley, each of said line members having a first end, a second end and an intermediate portion, said pulley connected only to said first flexible line member, said first flexible line member being secured to said pulley only at said first end;

(b) locating a support member at a camping site at an elevated height;

(c) passing said first line member over said support member so that said intermediate portion of said first line member passes over said support member and said pulley and said second end are each positioned adjacent the ground;

(d) passing said second flexible elongate line member through said pulley such that said intermediate portion of second flexible elongate line member is positioned within said pulley;

(e) raising said pulley to an elevated position above the ground and securing said pulley at said elevated position thereby raising said intermediate portion of said second flexible elongate line member to said elevated position;

(f) securing the payload to said first end of said second elongate flexible member; and, (g) raising the payload to said elevated position and securing the payload at said elevated position so that wild animals do not have access thereto.

2. In camping, a method to enable a single individual to raise a payload consisting essentially of camping equipment and/or provisions and store the payload at an elevated height above the ground comprising the steps of:

(a) providing a kit consisting essentially of first and second lengths of rope and a pulley, each of said ropes having a first end, a second end and an intermediate portion, said pulley connected only to said first rope, said first rope being secured to said pulley at only said first end;

(b) locating a support member at a camping site at an elevated height;

(c) throwing said pulley over said support member so that said intermediate portion of said first rope is positioned over said support member and said pulley and said second end of said first rope are each positioned adjacent the ground;

(d) passing said second rope through said pulley such that said intermediate portion of second rope is positioned within said pulley;

(e) using said second end of said rope to raise said pulley to an elevated position above the ground and securing said second end of said rope to a member secured to the ground while said pulley is at said elevated position thereby raising said intermediate portion of said second rope to said elevated position;

(f) securing the payload to said first end of said second rope; and, (g) using the second end of said second rope to raise the payload to said elevated position and securing said second end of said second rope to a member secured to the ground while the payload is at said elevated position.

3. The method as claimed in claim 2 wherein said support member is a branch of a tree.

4. The method as claimed in claim 3 wherein said member secured to the ground is selected from the group consisting of a tree, rock, root and a stake.

5. The method as claimed in claim 1 wherein the payload is secured to said first end of said second flexible elongate member prior to step (e).

6. The method as claimed in claim 1 wherein the payload is secured to said first end of said second elongate flexible member after step (e).

7. The method as claimed in claim 2 wherein the payload is secured to said first end of said second rope prior to step (e).

8. The method as claimed in claim 2 wherein the payload is secured to said first end of said second rope after step (e).

* * * * *